US006308483B1

(12) United States Patent
Romine

(10) Patent No.: US 6,308,483 B1
(45) Date of Patent: Oct. 30, 2001

(54) ROOFING FASTENER ASSEMBLY

(76) Inventor: Robert L. Romine, 6266 Appleman Rd. SE., Newark, OH (US) 43055

( * ) Notice: Subject to any disclaimer, the term of this patent is extended or adjusted under 35 U.S.C. 154(b) by 0 days.

(21) Appl. No.: 09/611,496

(22) Filed: Jul. 7, 2000

(51) Int. Cl.[7] ..... E04B 5/00

(52) U.S. Cl. ..... 52/410; 411/387; 411/387.6; 411/387.7; 411/383; 411/910; 411/531; 411/533; 411/520

(58) Field of Search ..... 52/410; 411/387, 411/383, 910, 387.6, 387.7, 531, 533, 525, 526

(56) References Cited

U.S. PATENT DOCUMENTS

| | | | |
|---|---|---|---|
| 4,074,501 | 2/1978 | Sandqvist . | |
| 4,236,555 | 12/1980 | Dewey . | |
| 4,361,997 | 12/1982 | DeCaro . | |
| 4,380,413 | 4/1983 | Dewey . | |
| 4,517,776 | 5/1985 | Barker . | |
| 4,545,270 | 10/1985 | Dewey . | |
| 4,601,625 | 7/1986 | Ernst et al. . | |
| 4,621,963 | 11/1986 | Reinwall . | |
| 4,642,012 | 2/1987 | Blucher et al. . | |
| 4,655,656 | 4/1987 | Jonsson . | |
| 4,757,661 | 7/1988 | Hasan . | |
| 4,762,453 | 8/1988 | DeCaro . | |
| 4,834,600 * | 5/1989 | Lemke | 52/410 |
| 4,852,323 * | 8/1989 | Kartfilt | 52/410 |
| 4,862,664 * | 9/1989 | Romine | 52/410 |
| 5,069,589 * | 12/1991 | Lemke | 52/410 |

FOREIGN PATENT DOCUMENTS

| | | |
|---|---|---|
| 2711-335 | 3/1977 | (DE) . |
| 3040-794 | 11/1979 | (DE) . |

OTHER PUBLICATIONS

The Romine Company, "RR–1 Insulated Screw Cap Assembly", advertisement.

* cited by examiner

*Primary Examiner*—Carl D. Friedman
*Assistant Examiner*—Chi Nguyen
(74) *Attorney, Agent, or Firm*—Jason H. Foster; Kremblas, Foster, Phillips & Pollick

(57) ABSTRACT

The present invention is a roofing fastener assembly. The assembly includes a fastener, a barbed washer, and a screw. The screw projects through the fastener and exits the free end of the fastener. Upon installation of the screw and fastener, the barbs of the washer penetrate into the roof membrane and insulation layer. An extending rim on the washer receives the head of the fastener to resist the relative lateral movement of the washer and fastener. Stabilizing fingers project from a free end of the fastener and hold the screw in place during assembly.

8 Claims, 3 Drawing Sheets

ROOFING FASTENER ASSEMBLY

CROSS-REFERENCES TO RELATED APPLICATIONS (Not Applicable)

STATEMENT REGARDING FEDERALLY-SPONSORED RESEARCH AND DEVELOPMENT (Not Applicable)

BACKGROUND OF THE INVENTION

1. Field of the Invention

The present invention relates to an improved roofing fastener assembly. More particularly, the present invention relates to an assembly which includes a fastener having a stabilizing finger and a barbed washer.

2. Description of The Related Art

In the roofing area, there is a problem with wind uplift. This problem occurs primarily with flat roofs which include a layer of insulation and a waterproof membrane covering the insulation. When the wind blows against such a roof membrane, the membrane tends to shift to some extent, and may billow or otherwise lift from the upper surface of the insulation. When the membrane lifts, forces are applied to the fastener assemblies which fasten the membrane and insulation to the roof deck, thereby loosening the screws. This causes a need to replace the screws which have loosened in order to (1) retain the insulation and membrane securely on the roof deck, (2) maintain the waterproof aspects of the roof, and (3) prevent injury due to heads of screws projecting above the surface of the membrane.

Others have made fastener assemblies which have included some structure which tends to reduce the wind uplift problem to some extent. These structures primarily take the form of some sort of washer mechanism. Structures such as these are disclosed in the patents to Sandqvist, U.S. Pat. Nos. 4,074,501; Reinwall, 4,621,963; and Blucher et al., 4,642,012. These patents teach employing a washer structure. However, a number of problems arise, which include the transfer of cold to the interior of the roof, tending to cause condensation.

This type of problem can be corrected, at least in part, by the inclusion of a recess which shields the screw from the exterior, to some extent. Examples of these types of washers are found in the patents to DeCaro, U.S. Pat. Nos. 4,361,997; Dewey, 4,380,413 and 4,545,270; Hasan, 4,757,661; Depperman, German Patent No. 2,711,335; and Protan, German Patent No. 3,040,794.

The problems mentioned above were solved in part by the invention disclosed in the patent to Romine, U.S. Pat. No. 4,862,664, and in the advertisement for the RR-1 insulated screw cap assembly manufactured and sold by the Romine company. This invention is effective to reduce damage caused by wind uplift borne on a membrane fastened with these types of fixtures, particularly while recessing the screw head to prevent the transfer of cold into the interior of a building. However, it has been determined that even this fastener assembly does not sufficiently reduce the damage caused by wind uplift on the membrane, to prevent loosening of the screws and permit billowing of the membrane.

Accordingly, what is needed is a fastener assembly which permits the screw head to be recessed to reduce the transfer of cold. The fastener assembly also should increase the stability of the engagement between the fastener and the insulating and membrane layers of the roof, to reduce the effects of wind uplift on the membrane relative to the fastener assembly. Additionally, the fastener assembly should be preassembled for ease of use. The present invention includes these desirable properties.

BRIEF SUMMARY OF THE INVENTION

The present invention relates to a roofing fastener assembly for securing a thermal insulation material and membrane to a roof deck. The assembly includes a T-shaped fastener, a screw, and an annular washer.

The fastener includes a head having a flat face and a tapered face. An elongated, tubular shank extends away from the tapered face and has a free end. An annular shoulder extends inwardly from the inner surface of the shank near its free end. A stabilizing finger is attached to the free end of the shank.

The screw includes a head which engages the fastener shoulder and a shaft which extends away from the head and has threads which engage the stabilizing finger. These parts cooperate to retain the screw in a designated position relative to the fastener.

The fastener assembly preferably also includes an annular washer which has a central aperture configured to surround the shank. The washer includes a first curved surface engaging the tapered face of the fastener and a second, oppositely-disposed curved surface having a plurality of outwardly-projecting barbs. A plurality of notches extend radially from the central aperture. A rim extends outwardly from the first curved surface and, in operative position, surrounds the head to inhibit movement of the fastener with respect to the membrane. The first curved surface is concave and the second curved surface is convex. The second curved surface may preferably include a plurality of concentric grooves.

Figure 1:
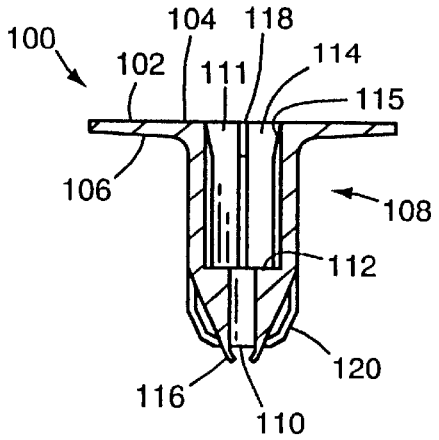
FIG. 1 is a cross-sectional view of a fastener for use in the fastener assembly of this invention.

In describing the preferred embodiment of the invention which is illustrated in the drawings, specific terminology will be resorted to for the sake of clarity. However, it is not intended that the invention be limited to the specific term so selected and it is to be understood that each specific term includes all technical equivalents which operate in a similar manner to accomplish a similar purpose. For example, the word connected or term similar thereto are often used. They are not limited to direct connection, but include connection through other elements where such connection is recognized as being equivalent by those skilled in the art. In addition, many elements are illustrated which are of a type which perform well known operations. Those skilled in the art will recognize that there are many, and in the future may be additional, alternative elements which are recognized as equivalent because they provide the same operations.

DETAILED DESCRIPTION OF THE INVENTION

The present invention is an improvement of the fastener assembly disclosed in the patent to Romine, U.S. Pat. No. 4,862,664. The present fastener includes many of the features disclosed in that patent with additional features. The disclosure of U.S. Pat. No. 4,862,664 is incorporated herein by reference, but is summarized herein as follows.

Figure 7:
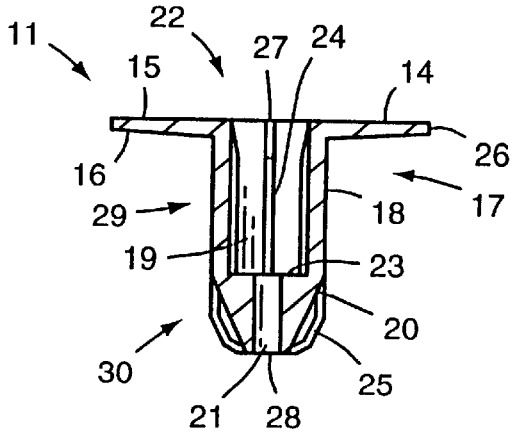
Fig. 7 Prior Art
FIG. 7 is a cross-sectional view of a prior art fastener.

The basic structure of the fastener is shown in FIG. 7. The fastener 11 is preferably made of a synthetic-resinous-polymeric material. The fastener 11 is generally T-shaped and includes a head 14 having a generally flat face 15 and a generally tapered face 16. The tapered face 16 tapers from a smaller thickness at its periphery 26 to a larger thickness as it nears the central area 27 of the fastener 11. An elongated, tubular shank 17 extends away from the tapered face 16 and has a free end 28. The shank 17 includes an exterior wall surface 18 and an interior wall surface 19, defining an aperture 22, on an upper portion 29. Near the free end 28 of the shank 17, an annular shoulder 23 extends inwardly from the inner surface 19 of the shank 17. In this lower portion 30 of the shank 17, the inner wall surface 21 defines an aperture of smaller circumference than the inner wall surface 19 of the upper portion 29. The outer wall surface 20 of the lower portion 30 forms a generally truncated conical shape.

The fastener 11 must be designed to permit the inner wall surface 19 of the aperture 22 to mate or couple with a driving tool (not shown in this FIG.—see FIG. 5) for rotatably driving the fastener 11. The fastener 11 preferably includes ridges 24 projecting inwardly from the inner surface 19 for this purpose.

The lower outer surface 20 must also include a plurality of flutes 25 configured to function as cutting flutes. These cutting flutes 25 permit ingress of the shank 17 into a hollow created by the flutes 25. These flutes cooperate with a standard screw 12 (best seen in FIG. 5) to create an appropriate hollow.

The present invention, as shown in FIG. 1, includes a number of these features. The present T-shaped fastener 100 includes a head 102 having a flat face 104 and a tapered face 106. An elongated, tubular shank 108 extends away from the tapered face 106 and has a free end 110. A bore 111 passes through the center 118 of the shank 108 and the head 102. An annular shoulder 112 extends inwardly from the inner surface 114 of the shank 108 near the free end 110 of the shank 108. A plurality of ridges 115 also extend inwardly from the inner surface 114 of the shank 108. The present fastener 100 also includes cutting flutes 120 which have the same characteristics as described above.

The present invention also includes a pair of stabilizing fingers 116. The stabilizing fingers 116 are attached to the free end 110 of the shank 108. These fingers 116 are used to properly position the screw (not shown in this FIG.—see FIG. 5), as will be described in greater detail below. The fingers 116 preferably project from the shank 108 generally towards the center 118 of the shank 108. While two fingers 116 are shown, this is merely the preferred embodiment. Only one finger 116 need be used and as many as four fingers 116 may be used. If multiple fingers 116 are used, it is preferred that they be spaced evenly around the circumference of the free end 110 to evenly support the screw. The fingers 116 should be flexible, but provide sufficient friction to appropriately position the screw and hold it in place in a unitary preassembled, ready-to-use condition, but not to such a degree that they negatively affect the ability of the screw to rotate. It is preferred that the fingers 116 project at about a 45 degree angle.

Figure 2:
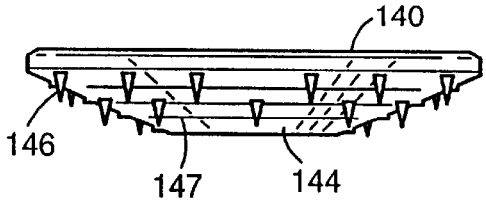
FIG. 2 is a side view of a washer for use in the fastener assembly of this invention.
Figure 3:
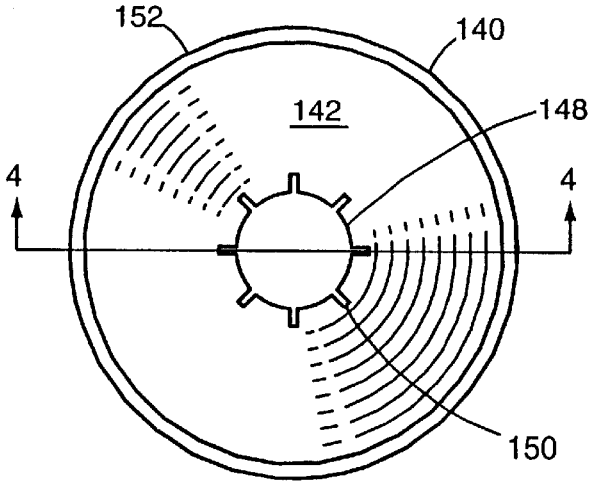
FIG. 3 is a top view of the washer of FIG. 2.
Figure 4:
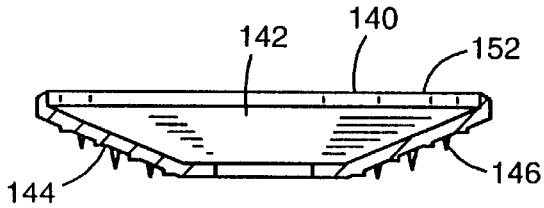
FIG. 4 is a cross-sectional view of the washer of FIG. 3 taken along line 4—4 of FIG. 3.

The fastener assembly of the present invention also includes a washer 140, as shown in FIGS. 2–4. The washer 140 includes a first curved surface 142 and a second, oppositely-disposed curved surface 144. The first curved surface is configured to engage the tapered face 106 of the fastener 100 and is concave. The second curved surface 144 is convex and includes a plurality of outwardly-projecting barbs 146. The washer 140 also includes a central aperture 148, best seen in FIG. 3, which is surrounded by a plurality of notches 150 which extend radially from the central aperture 148. The inclusion of the notches 150 increases the flexibility of the material surrounding the aperture 148 to enable this region of the washer 140 to bend more easily than the remainder of the washer 140. The barbs 146 are preferably about 3/16 inch long. The reason for this length is that the barbs 146 must penetrate at least through the roof membrane and into the insulation, which can often have a dense face sheet. The membrane is typically about 1/16 inch thick. The 3/16 length is sufficient, therefore, to ensure adequate penetration and adhesion between the roofing fastener assembly and the roof material. It is preferred that the washer 140 also include a plurality of concentric ridges or grooves 147 (best seen in FIG. 6) to further ensure that the washer 140 resists sliding or other lateral movement when subjected to the forces caused by wind uplift. The washer 140 further includes a rim 152 which extends outwardly from the first curved surface 142. When the fastener 100 and the washer 140 are disposed operative position, the rim 152 surrounds the head 102 of the fastener 100, as will be described in greater detail below.

Figure 6:
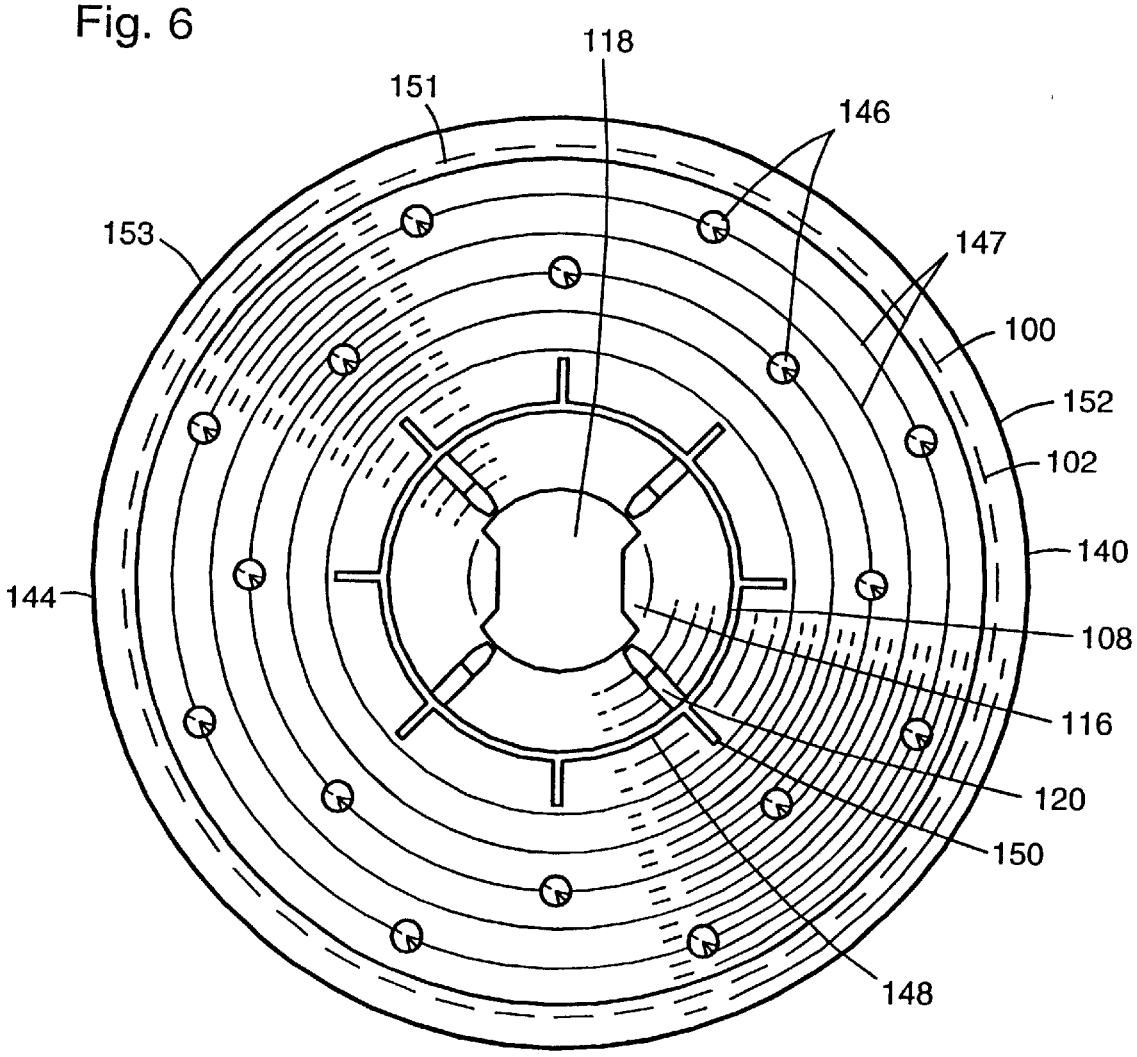
FIG. 6 is a bottom view of the fastener assembly.

The cooperation and location of a number of the parts of the fastener assembly are seen more clearly in FIG. 6. As shown, the aperture 148 and notched area 150 of the washer 140 slidably engage and surround the shank 108. The barbs 146 and concentric grooves 147 project from the second side 144 of the washer 140. The stabilizing fingers 116 extend from the shank 108 towards the center 118 of the shank 108. The dashed line shows the general position of the head 102 of the fastener 100 when the assembly has been assembled. The circumference 151 of the head 102 is spaced a selected distance from the circumference 153 of the washer 140. The rim 152, best seen in FIGS. 3 and 4, substantially fills this space. Accordingly, in the installed, operative condition, the rim 152 of the washer 140 surrounds the head 102 in a relatively close-fit relationship to resist movement of the head 102 with respect to the washer 140 and hence the membrane 57.

Figure 5:
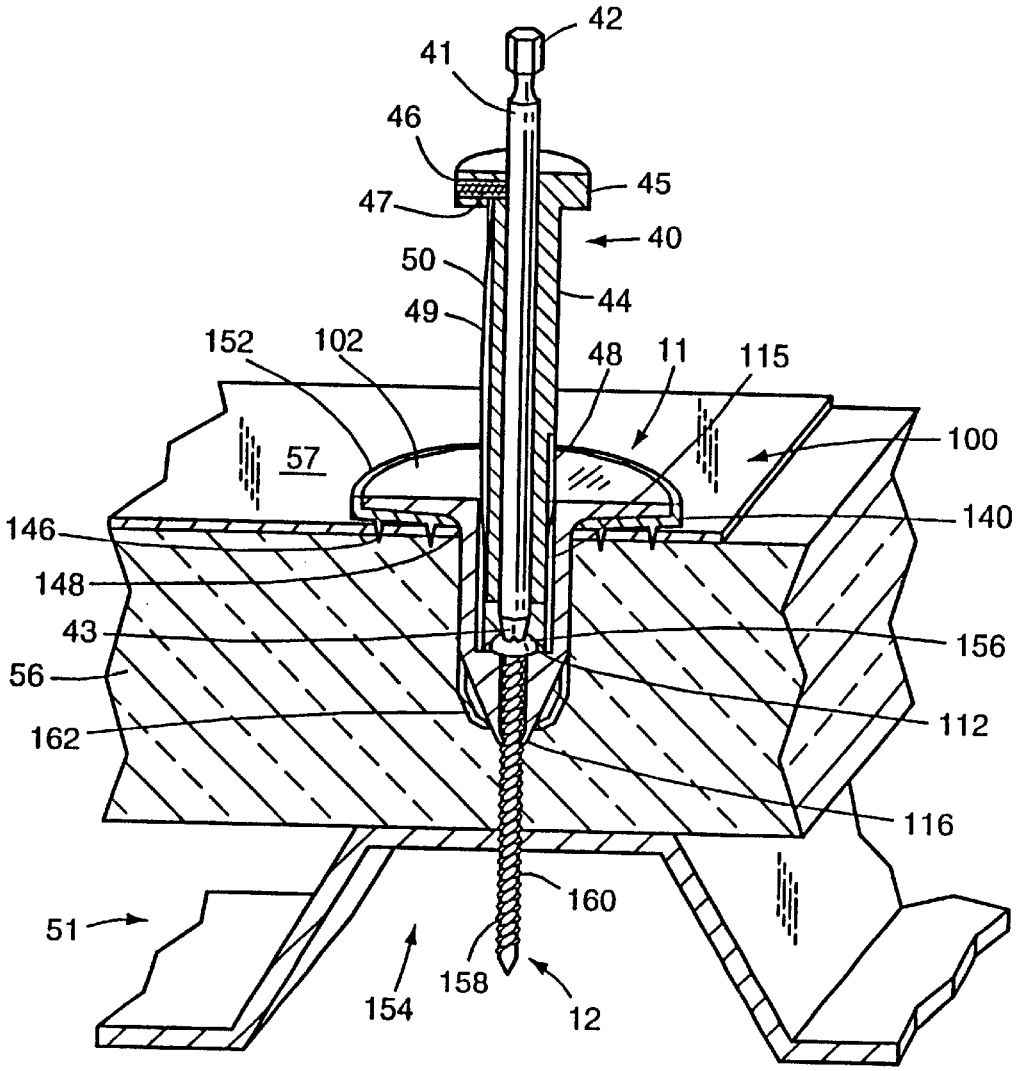
FIG. 5 is a perspective view, partially in section, of the fastener assembly of the present invention at an intermediate stage of preparation of the finished roof assembly with a rotatable tool of the invention in engagement with the screw and the fastener.

The fastener assembly 154 is shown being installed in operative position in FIG. 5. A rotatable tool 40 is used to install the fastener assembly 154. The tool 40 includes a generally cylindrical shaft 41, which includes a head 42 which is configured to engage a drill (not shown) or other apparatus standard in the industry for rotatably driving the shaft 41. The other end of the shaft 41 includes a tip 43 which is configured to mate with a phillips-head screw 12. Other types of standard configurations, such as a flat-head or hexagonal configuration, may be used in place of the standard phillips-head configuration disclosed and come within the scope of the present invention. A tubular component 44 surrounds a portion of the shaft 41. The tube 44 and shaft 41 are preferably only frictionally-engaged, but may also be made integrally, but are preferably formed from standard components, for purposes of cost reduction. It is also preferred that the tube 44 and shaft 41 be separate in order to permit differently sized shafts 41 and tubes 44 to be used for a variety of sizes of fasteners 100. The tube 44 also includes a plurality of slots 48 which engage the ridges 115. When the tube 44 engages the ridges 115, it enables rotation of the fastener 100 upon rotation of the tool 40. The tool 40 may further include a spring 49 in a slot 50 to ensure a close fit between the tool 40 and the fastener 100. A set screw 47 in an integral ring 46 attaches the tubular component 44 and the spring 49.

The fastener assembly 154 is used in securing a membrane 57 and an insulation layer 56 to a deck 51. The fastener assembly 154 is preferably pre-assembled to include the fastener 100, the washer 140, and the screw 12. The screw 12 is preferably between a #10 screw and a #14 screw in size, depending on the particular needs of a particular project. The screw 12 is inserted into the fastener 100 until the screw head 156 rests against or engages the shoulder 112. The shaft 158 of the screw 12 projects from the free end 110 of the fastener 100. The shaft 158 includes threads 160. Once the shaft 158 begins to project from the free end of the fastener 100, the threads 160 engage the stabilizing fingers 116. These fingers 116 are sufficiently flexible to permit the shaft 158 to pass therethrough as it exits the fastener 100, but resist vertical movement of the shaft 158 in the reverse direction. The fingers 116 are not so rigid as to prevent the screw 12 from rotating, since the screw 12 must be permitted to rotate. The fingers 116 apply only a sufficient frictional engagement on the threads 160 to retain the screw 12 in a designated position relative to the fastener 100 to form a unitary fastener assembly 154 for convenience of handling and use.

The annular washer 140 is positioned to permit the shaft 108 of the fastener 100 to pass through its central aperture 148. The washer 140, particularly the notches 150, permit the washer 140 to be placed in slidable, frictional engagement with the shaft 108 near the tapered face 106. The washer 140 is positioned in spaced relationship to the tapered face 106 prior to being installed on a roofing structure. However, the central aperture 148 corresponds in size to the shaft 108 of the fastener 100 so that a relatively light frictional engagement tends to retain the washer 140 in a selected position on the shaft 108 prior to installation. Thus, the fastener assembly 154, including the fastener 100, the washer 140, and the screw 12, forms a unitary assembly prior to installation for convenience of handling and use.

In installing the assembly, the tool 40 is inserted into the fastener 100, engaging the ridges 115. The tool 40 is then rotated by the drill (not shown). The screw 12 rotates and penetrates the membrane 57, the insulation layer 56, and the deck 51 in a standard configuration. As the rotating screw 12 passes further into the insulation 56 and deck 51, the fastener 100 is drawn into contact with the membrane 57. The fastener 100 includes flutes 162 which cut a path allowing the fastener shank 108 to penetrate through the membrane 57 and into layer 56.

After the fastener 100 penetrates the membrane 57 and insulation 56 to a given depth, the washer 140 is drawn into contact with the membrane 57. The washer barbs 146 penetrate the membrane 57 and project into the insulation 56. The engagement between the barbs 146 and the roofing materials 56, 57 resists the rotation of the washer 140 relative to the rotation of the fastener 100. As the fastener advances, the downward force applied to the washer 140 tends to deform the washer 140 to conform to the shape of the tapered face 106 of the fastener 100. This deformation also causes a curvature in the notched area 150 of the washer 140 to conform that area to the radius of curvature joining the tapered face 106 and the shank 108.

When the assembly has been installed, it appears as shown in FIG. 5. The washer 140 is deformed to engage the tapered face 106 of the fastener 100, and the central aperture 148 is in surrounding engagement with the shank 108. The rim 152 closely surrounds the fastener head 102. This assembly 154 provides greater stability of the position of the fastener 100 relative to the membrane 57 and insulation 56 to reduce the effects of wind uplift to cause a shifting of the fastener 100. This is due to the interaction between the fastener 100 and holding or gripping forces applied by the washer 140. Without the stabilizing effect of the washer 140, the prior art fastener assemblies tended to shift position with respect to the membrane 57 and insulation 56 subjected to the effects of wind uplift on the membrane. The barbs 146 spread over the area covered by the washer 140 tend to hold the washer 140 in place relative to the membrane 57 and insulation 56. The rim 152 surrounding the head 102 tends to hold the fastener 100 in its original position with respect to the washer 140 and the membrane 57. Accordingly, the present fastener assembly 154 reduces the effects of high wind tending to shift the position of the fastener 100 and thereby significantly loosen it relative to the originally installed condition.

While certain preferred embodiments of the present invention have been disclosed in detail, it is to be understood that various modifications may be adopted without departing from the spirit of the invention or scope of the following claims.

What is claimed is:

1. A roofing fastener assembly for securing a thermal insulation material to a roof deck, the assembly comprising:

(a) a T-shaped fastener, comprising:

(1) a fastener head having a planar face and an oppositely-directed, tapered face;

(2) an elongated, tubular shank extending away from the tapered face and terminating in a free end, said shank having a bore extending through the fastener head and the fastener shank;

(3) an annular shoulder extending inwardly from an inner surface of the bore near the free end of the shank; and (4) a retaining finger attached to the free end of the shank, said finger having a tip, and said finger extending downwardly and radially inwardly from the fastener shank toward the center of the bore;

(b) a screw, comprising:

(1) a screw head which engages the annular shoulder in the bore; and (2) a screw shaft of equal diameter along the length of the shaft and extending through the bore away from the fastener head, the screw shaft having threads against which the tip of the retaining finger continuously seats, thereby retaining the screw in a predetermined position relative to the shank; and (c) an annular washer having a central aperture surrounding the shank, the washer comprising:

(1) a concave major surface engaging the tapered face;

(2) a convex major surface having a plurality of outwardly-projecting barbs;

(3) a plurality of notches extending radially outwardly from the central aperture; and (4) a rim extending outwardly from the convex major surface in a surrounding engagement with the fastener head and resisting lateral movement of the fastener head relative to the washer.

2. The roofing fastener assembly according to claim 1, wherein the convex major surface includes a plurality of concentric grooves.

3. A combination of a roofing fastener assembly, a membrane lying within a membrane plane, a thermal insulation material and a roof deck, the combination comprising:

(a) a T-shaped fastener, comprising:

(i) a fastener head having a planar face lying vertically beneath the membrane plane, an oppositely-directed, tapered face and a peripheral edge;

(ii) an elongated, tubular fastener shank extending downwardly from the tapered face and terminating at a free end, said shank having a bore with an inner surface extending from the fastener head through the fastener shank;

(iii) an annular shoulder extending radially inwardly from the inner surface of the bore intermediate the fastener head and the free end of the shank; and (iv) a retaining finger extending radially inwardly from the inner surface of the bore near the free end of the shank;

(b) a screw, comprising:

(i) a screw head engaging the annular shoulder; and (ii) a screw shaft having spiral threads, said screw shaft extending through the bore away from the fastener head, seating against the retaining finger; and (c) an annular washer having a central aperture surrounding the shank, the washer comprising:

(i) a concave major surface seated against the tapered face of the fastener head;

(ii) an oppositely directed, convex major surface having a plurality of barbs extending from rigid attachment to said convex major surface into and through the membrane and into the insulation;

(iii) a plurality of notches extending radially outwardly from the central aperture; and (iv) a rim at the peripheral edge of the washer, said rim extending from the concave major surface and seating against the peripheral edge of the fastener head to resist lateral movement of the fastener head relative to the washer.

4. A method of removably mounting a roofing fastener assembly through a roofing membrane lying in a plane and thermal insulation material to a roof deck, the method comprising:

(a) providing a T-shaped fastener, said fastener comprising:

(i) a fastener head having a planar face, an oppositely-directed, tapered face and a peripheral edge;

(ii) an elongated, tubular fastener shank extending away from the tapered face and terminating at a free end, said shank having a bore with an inner surface extending from the fastener head through the fastener shank;

(iii) an annular shoulder extending radially inwardly from the inner surface of the bore intermediate the fastener head and the free end of the shank; and (iv) a retaining finger extending radially inwardly from the inner surface of the bore near the free end of the shank;

(b) inserting a self-tapping screw into said T-shaped fastener until a screw head seats against the annular shoulder and a screw shaft, having spiral threads and a tip, extends through the bore away from the fastener head, said retaining finger stabilizing the screw in position relative to the fastener; and (c) inserting the fastener shank through a central aperture of an annular washer, the washer comprising:

(i) a concave major surface adjacent the tapered face of the fastener head;

(ii) an oppositely directed, convex major surface having a plurality of barbs extending from rigid attachment to said convex major surface;

(iii) a plurality of notches extending radially outwardly from the central aperture; and (iv) a rim at the peripheral edge of the washer, said rim extending from the concave major surface for seating against the peripheral edge of the fastener head to resist lateral movement of the fastener with respect to the washer;

(d) rotating the screw, the T-shaped fastener and the washer relative to the membrane with a rotary tool when the tip of the screw is in contact with the membrane and applying a downward force, thereby forming an opening in the membrane and insulation into which the screw shaft extends, and into the roof deck into which the screw extends, thereby punching the barbs of the washer through the membrane and into the insulation and ceasing rotary motion of the washer; and then (e) further rotating the screw and T-shaped fastener relative to the washer and membrane after the barbs of the washer punch through the membrane until the tapered face of the fastener head seats against the concave major surface of the washer, the peripheral edge of the fastener head seats near the rim of the washer and the planar face of the fastener seats beneath the plane of the membrane.

5. A roofing fastener assembly for securing a thermal insulation material to a roof deck, the assembly comprising:

(a) a T-shaped fastener, comprising:

(1) a fastener head having a planar face and an oppositely-directed, tapered face;

(2) an elongated, tubular fastener shank extending away from the tapered face and terminating in a free end, said shank having a bore extending through the fastener head and the fastener shank;

(3) an annular shoulder extending inwardly from an inner surface of the bore near the free end of the shank; and (b) a screw, comprising:

(1) a screw head which engages the annular shoulder in the bore; and (2) a screw shaft of equal diameter along the length of the shaft and extending through the bore away from the fastener head, the screw shaft having threads, and (c) an annular washer having a central aperture surrounding the shank, the washer comprising:

(1) a concave major surface engaging the tapered face;

(2) a convex major surface having a plurality of outwardly-projecting barbs;

(3) a plurality of notches extending radially outwardly from the central aperture; and (4) a rim extending outwardly from the convex major surface in a surrounding engagement with the fastener head and resisting lateral movement of the fastener head relative to the washer.

6. The roofing fastener assembly of claim 5 wherein the T-shaped fastener further includes a retaining finger attached to the free end of the shank, said finger having a tip in continuous contact with the screw shaft, and said finger extending downwardly and radially inwardly from the fastener shank toward the center of the bore.

7. A roofing fastener assembly for securing a thermal insulation material to a roof deck, the assembly comprising:

(a) a T-shaped fastener, comprising:

(1) a fastener head having a planar face and an oppositely-directed, tapered face;

(2) an elongated, tubular fastener shank extending away from the tapered face and terminating in a free end, said shank having a bore extending through the fastener head and the fastener shank;

(3) an annular shoulder extending inwardly from an inner surface of the bore near the free end of the shank; and (4) a retaining finger attached to the free end of the shank, said finger having a tip, and said finger extending downwardly and radially inwardly from the fastener shank toward the center of the bore, and;

(b) a screw, comprising:

(1) a screw head which engages the annular shoulder in the bore; and (2) a screw shaft of equal diameter along the length of the shaft and extending through the bore away from the fastener head, the screw shaft having threads against which the tip of the retaining finger continuously seats, thereby retaining the screw in a predetermined position relative to the shank; and (c) an annular washer having a central aperture surrounding the shank, the washer comprising:

(1) a major surface having a plurality of outwardly-projecting barbs;

(2) a plurality of notches extending radially outwardly from the central aperture; and (3) a rim extending outwardly from the major surface in a surrounding engagement with the fastener head and resisting lateral movement of the fastener head relative to the washer.

8. The roofing fastener assembly of claim 6, wherein the annular washer further includes (1) a concave major surface engaging the tapered face;

(2) a convex major surface having a plurality of outwardly-projecting barbs;

(3) a plurality of notches extending radially outwardly from the central aperture; and (4) a rim extending outwardly from the convex major surface in a surrounding engagement with the fastener head and resisting lateral movement of the fastener head relative to the washer.

* * * * *